US007423244B2

(12) United States Patent
Baier et al.

(10) Patent No.: US 7,423,244 B2
(45) Date of Patent: Sep. 9, 2008

(54) HEATING DEVICE FOR A PLANAR HEATER WITH INDUCTION HEATING ELEMENTS

(75) Inventors: Martin Baier, Ettlingen (DE); Lutz Ose, Sternenfels (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 0 days.

(21) Appl. No.: 11/690,053

(22) Filed: Mar. 22, 2007

(65) Prior Publication Data

US 2007/0215605 A1 Sep. 20, 2007

Related U.S. Application Data

(63) Continuation of application No. PCT/EP2004/010664, filed on Sep. 23, 2004.

(51) Int. Cl.
*H05B 6/12* (2006.01)
*H05B 6/06* (2006.01)

(52) U.S. Cl. ..... 219/624; 219/626; 219/662; 219/665

(58) Field of Classification Search ..... 219/620–627, 219/661–667, 672–676
See application file for complete search history.

(56) References Cited

U.S. PATENT DOCUMENTS

| | | | | |
|---|---|---|---|---|
| 3,204,074 | A * | 8/1965 | Hunting, Jr. | 219/677 |
| 4,348,571 | A | 9/1982 | Dills | |
| 4,431,892 | A | 2/1984 | White | |
| 4,453,068 | A * | 6/1984 | Tucker et al. | 219/625 |
| 4,490,596 | A | 12/1984 | Hirai et al. | |
| 5,428,207 | A | 6/1995 | Essig et al. | |
| 5,488,214 | A | 1/1996 | Fettig et al. | |
| 5,808,280 | A * | 9/1998 | Gaspard | 219/624 |
| 6,498,325 | B1 * | 12/2002 | Akel et al. | 219/624 |
| 6,614,006 | B2 | 9/2003 | Pastore et al. | |
| 7,126,095 | B2 * | 10/2006 | Alfredeen | 219/622 |
| 2001/0008237 | A1 | 7/2001 | Essig | |

FOREIGN PATENT DOCUMENTS

| | | |
|---|---|---|
| DE | 2306037 | 8/1974 |
| DE | 100 58 412 A1 | 6/2002 |
| DE | 202 04 249 A1 | 7/2002 |
| DE | 10163839 A1 | 7/2003 |
| DE | 102 58 726 | 6/2004 |
| EP | 0722261 A1 | 7/1996 |
| EP | 1463383 A1 | 9/2004 |

OTHER PUBLICATIONS

German Search Report corresponding to International Application No. 103 14 690.3 dated Jan. 27, 2004.
International Search Report corresponding to International Application No. PCT/EP2004/010664 dated May 6, 2005. PCT/ISA/237.

* cited by examiner

*Primary Examiner*—Philip H Leung
(74) *Attorney, Agent, or Firm*—Alston & Bird LLP

(57) ABSTRACT

A heater for a hob or cooktop having a glass ceramic surface is disclosed, whereby a number of individual modules with induction coils are provided with converters and a converter control for each induction coil. The modules may be independently assembler and/or replaced, and are arranged close together beneath the glass ceramic hob and electrically connected to a busbar. Each module may be controlled separately. A heated surface of using various combinations of modules can thus be achieved.

25 Claims, 4 Drawing Sheets

HEATING DEVICE FOR A PLANAR HEATER WITH INDUCTION HEATING ELEMENTS

RELATED APPLICATIONS

This application is a continuation of international patent application PCT/EP2004/010664, filed on Sep. 23. 2004.

FIELD OF APPLICATION

The invention relates to a heating device for a planar heater like a hob or cooktop. The heating device has a planar support on which are distributed the induction heating elements, such as induction heating elements.

BACKGROUND

It is known from EP 1 206 164 A2 to place a plurality of individually controllable radiant heating elements on a support. However, they have a complicated connection by means of distributed power supply conductors.

From EP 722 261 A1, it is known in the case of an induction hotplate to provide several independently operable induction zones, where once again there is a complicated power supply. The problem more particularly arises in the case of induction heaters because the electrical power typically incorporate converter circuits or the like. Due to frequencies in the range of a few hundred Hz to a few one thousand Hz, the interference susceptibility is high in the case of complicated connecting leads.

Thus, there is a need to provide an aforementioned heating device, which can avoid the disadvantages of the prior art and in particular the construction and electrical connection of such a heating device can be improved and simplified.

BRIEF DESCRIPTION OF THE DRAWINGS

Embodiments of the invention are diagrammatically shown in the drawings and is explained in greater detail hereinafter, wherein.

DETAILED DESCRIPTION

Figure 1:
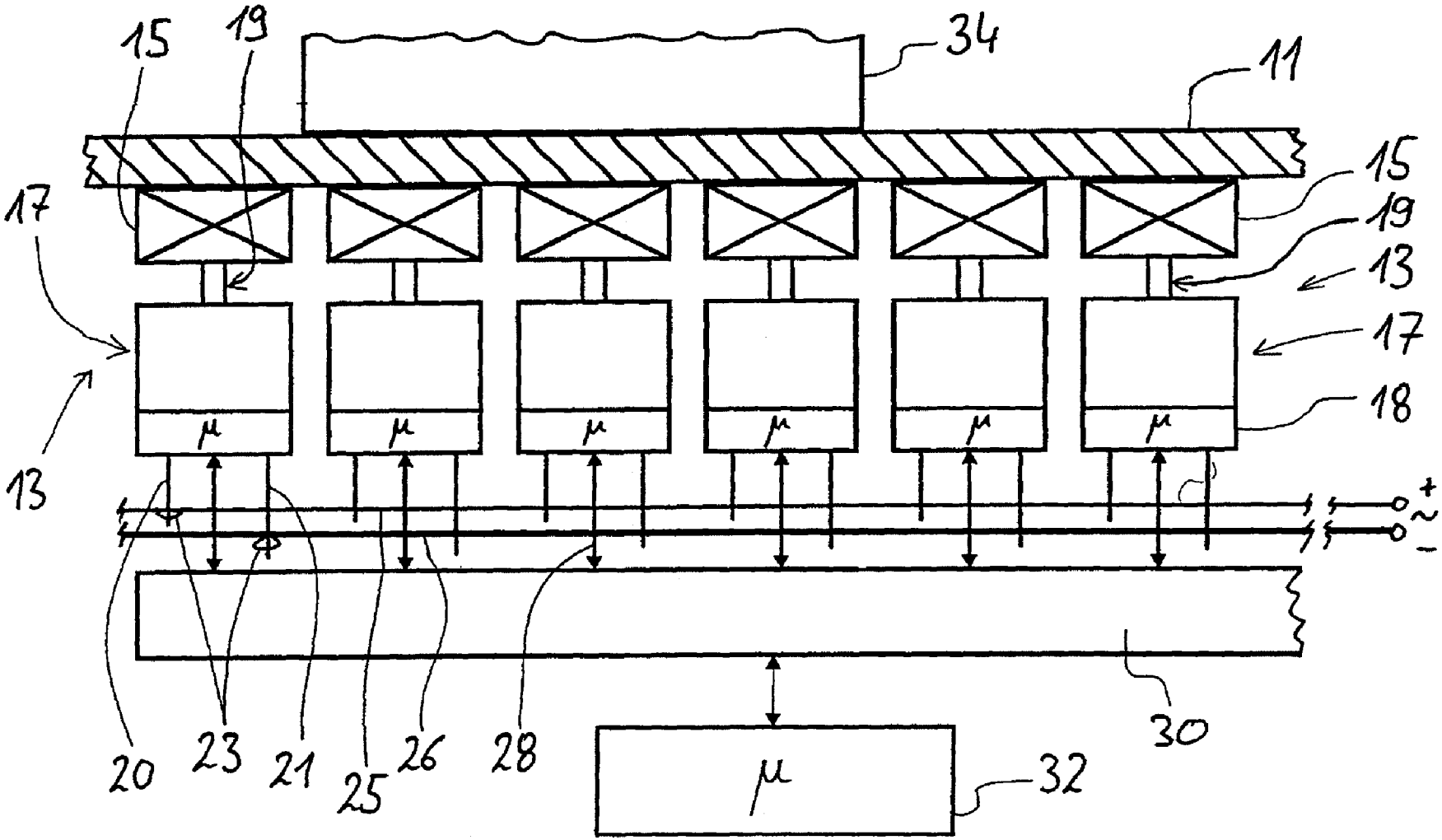
FIG. 1 is a side view of a plurality of modules with induction coils and converters placed under a glass ceramic hob and which are in each case controlled.
Figure 1A:
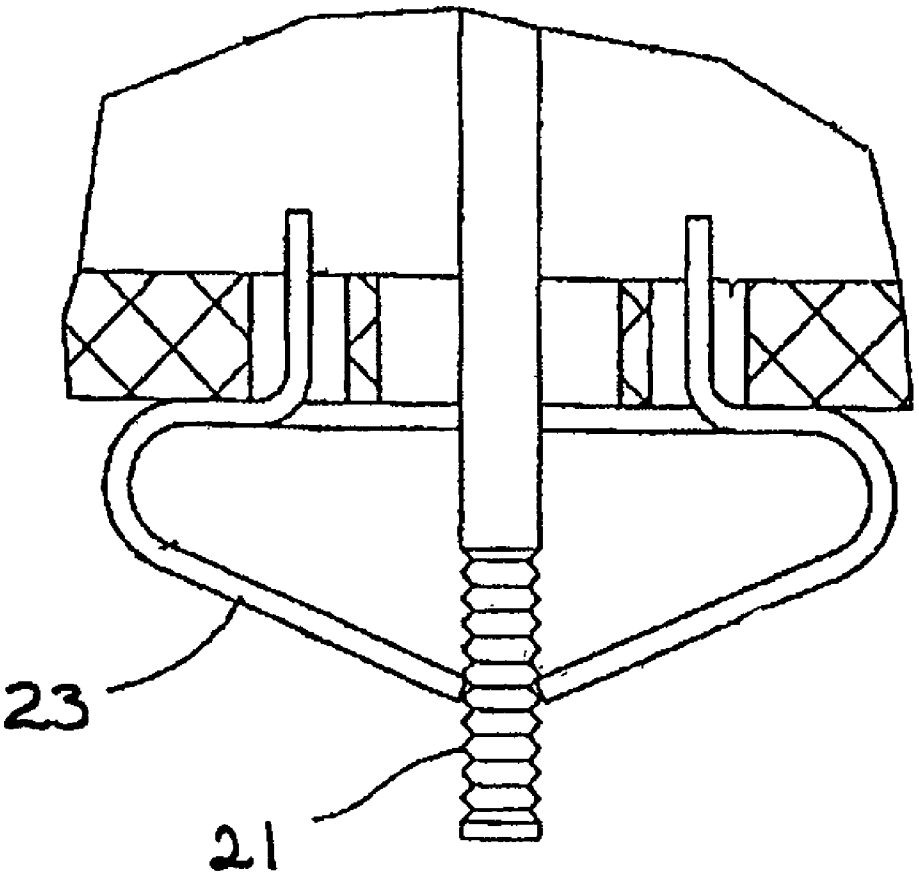
FIG. 1*a* is a depiction of a spring clip.

In one embodiment, the above problem is solved by a heating device having the features of claim 1. Advantageous and preferred developments of the invention form the subject matter of further claims and are explained in greater detail hereinafter. By express reference the wording of the claims is made into part of the content of the description.

According to one embodiment of the invention, a heating device has induction heating elements, which together with a converter device ("converter") form a module. The module can be independently handled and assembled on a support with a plurality of further such modules in order to form a heating device. It is advantageously possible to so construct an induction heating element and a converter device that they can be fixed to one another and in this way connected to form a module.

One advantage of this arrangement is that it facilitates connection of the induction heating elements. In particular, as a result of the spatially close arrangement of the induction heating element and converter device, susceptibility to interference is reduced. Further, it is also facilitates repair of a defective heating device, to remove a defective module and replace it with a functioning module. Thus, apart from the assembly, the replacement of individual induction heating elements and/or converter devices is also simplified.

According to a further embodiment of the inventions an induction heating element has a single induction coil and a single converter, i.e. for said induction coil. Thus, the induction heating elements can be kept relatively simple. A further advantageous aspect of the invention is that it facilitates subdividing a heating device, particularly a hob, for inductive heating into several small, individual induction heaters. It is advantageous, as can also be gathered from the aforementioned prior art, if there are several or a plurality of induction heating elements. Each induction heating element can be individually controllable as a function of whether or not a cooking vessel is standing thereon or in what form a heater is required.

An induction heating element can be fixed or connected to the support by means of an electrical connection. Said electrical connection preferably comprises connecting leads for the power supply. These connecting leads are advantageously solid, which leads to a certain strength of the connection. It is advantageous if the fixture forms the electrical connection of the heating device to one induction heating element.

For each connection or fixture, the connecting leads or wires for the power supply can be held in a spring clip. Advantageously, said spring clip is self-closing, so that following insertion both a contact and a clamping fixture is obtained.

The spring clips can be provided on the support, particularly with a clamping direction away from the support. It is advantageous to place the spring clip on the other side of the support. It is possible to provide the surface of the support exclusively for the fixing and arrangement of the induction heating elements or the modules with converters. On the other side of the support the spring clips can be connected to corresponding power terminals. The spring clips can be placed on a holder instead of directly on the support. In turn, the holder can be connected to several or all of the spring clips on the support. It can be a circuit board, which, in addition to spring clips, carries conducting tracks for the power supply.

As the separate modules of the induction heating elements may have their own converters, it is possible to assemble a power supply of several induction heating elements and lead it to a terminal. This can be a busbar or the like, to which are advantageously connected all the induction heating elements of a heating device.

On an induction heating element can also be provided control terminals with which it, or the converter, is controlled. Contacting on the control terminals can take place in random different ways. Preferably, there is a detachable contacting, particularly with a plug arrangement, and this can also perform a holding function. Contacting can also correspond to the terminals for the power supply of a module.

To reduce the connection effort and expenditure for the control of the modules or induction heating elements, several or all the control terminals can pass via a bus system. Said bus system can either be combined with a power supply of the induction heating elements, for example by modulating on a mains voltage or supply voltage, but preferably the control is separated from the power supply. Such a bus system can be constructed as a two-wire bus. Corresponding electric lines can connect all the induction heating elements and by means of the bus system, individual induction heating elements can respond in planned manner.

With respect to the structure of the heating device or an arrangement of induction heating elements, it is advantageous to juxtapose the same. In particular, they are arranged in a directly engaging, juxtaposed manner. This permits a particularly dense occupancy of the surface of the heating device or the support with induction heating elements and therefore with an induction heating action. It is advantageous for this purpose if the induction heating elements are shaped in such a way that they can be assembled with further identical shapes to form a substantially closed surface. Preferred shapes can comprise suitable squares or regular hexagons, which can be assembled without a gap.

According to a further embodiment of the invention, particularly with the previously described bus system for controlling individual induction heating elements, it is possible to allocate to each induction heating element its own control or place in the module. Said control should have an intelligent construction in such a way that it can at least partly carry out the evaluation of control signals or signals of a cooking vessel detection means. This means that the control is controlled via the bus system and with corresponding control instructions, it is possible to activate the induction heating element with certain characteristics, particularly the power level and/or power duration.

Advantageously, detection of a cooking vessel takes place by means of the induction heating element in such a way that a current flow is evaluated during heating operation. This evaluation can be carried out by the control, which on the basis of the current flow emits a clear signal as to whether or not a suitable cooking vessel is placed over the induction heating element. Advantageously, means for measuring the current flow are provided for this purpose. An advantage in this case is that there is no need to transmit signals from a single module over a longer path to a central control of the heating device. The pre-evaluation in the control of the individual module permits the formation of a specific signal, which is improved with respect to the interference susceptibility and evaluatability. In particular, the control of a module completely evaluates a cooking vessel detection means and supplies a positive or negative signal to a central control.

A monitoring of the current flow through an induction heating element, an induction coil thereof, or a monitoring of the power is advantageously linked with a converter device. The determination on the current flow or the power consumption is obtained from the normal operation of the converter device.

As has been described hereinbefore, an induction heating element advantageously has a single induction coil. Advantageously in the case of small modules, it has a multi-winding construction, for example, in the range of 50 to 100 windings. The power range can extend from a low level, for example 50 Watts to a few 100 Watts, or even up to at least 1 kilowatt. A coil wire advantageously has a large number of individual strands with such a number of windings. Thus, as a result of the skin effects it is particularly suitable for this application.

A heating device can advantageously have a central control, which is connected to all the induction heating elements and controls the same or evaluates their operation and the signals thereof, such as for example in the case of a cooking vessel detection, as well as miscellaneous data. The central control can advantageously be constructed in such a way that it detects an occupancy state of the heating device from a response of a cooking vessel detection means coming from the individual induction heating elements. Thus, it is able to establish whether one or more suitable cooking vessels for the induction heater are in place. Moreover, from the spatially distributed signals of the individual induction heating elements, the central control can detect at what point cooking vessels are in place and which induction heating elements are adequately covered and can be operated. It is possible by means of the central control to pass a power level preset by an operator to the individual induction heating elements for the purpose of controlling the same. When using a bus system, it is very easily possible by means of a central control, to control a specific induction heating element with information on the desired power stage. By means of its own converter, the induction heating element converts the power stage information.

It is possible with a central control to individually control each separate induction heating element. However, in operation, advantageously in each case, it is possible to combine several induction heating elements to form a heatable surface, which corresponds to an otherwise conventional hotplate. The advantage of a heating device with a plurality of induction heating elements is that such a hotplate can arise at a random location. Thus, several cooking vessels can be operated in juxtaposed manner at a random location.

These and further features can be gathered from the claims, description and drawing and the individual features, both singly or in the form of subcombinations, can be implemented in an various embodiments of the invention and in other fields and can represent advantageous, independently protectable constructions for which protection is claimed here. The subdivision of the application into individual sections and the subheadings in no way restricts the general validity of the statements made thereunder.

The diagrammatic representation of FIG. 1 shows a glass ceramic hob 11, beneath which there are several juxtaposed modules 13. These modules 13 have a limited spacing from one another and are advantageously in engagement with one another. They are fixed to a support (not shown), for example a metal plate. They can be in the form of single or individual modules. As stated hereinbefore, they can also be assembled, for example, without a support.

The modules 13, in each cases comprise an induction coil 15 and a converter 17, the latter having a converter circuit. It also has a converter control 18, advantageously with a microcontroller. The induction coil 15, which is applied to the underside of the glass ceramic hob 11, is connected to the converter 17 by a connection 19. Said connection is firstly mechanically retaining and secondly electrically conductive. In one embodiment, this can be a plug connection by means of which the converter 17 feeds power to the induction coil 15.

By means of connecting wires 20, 21, each of the converters 17 are connected to spring clips 23, which are in turn connected to a positive busbar 25 and a negative busbar 26. The construction of such spring clips 23 and their fitting to the busbars 25, 26 can be gathered, for example, from DE 102 587 26.4, to which express incorporation by reference is made to the contents.

The converters 17 are also connected by control terminals 28 to a bus system 30, which will be described in greater detail hereinafter. In turns the bus system 30 is connected to a central control 32. By means of the bus system 30, said central control 32 supplies instructions to individual converters 17 for the operation of the induction coils 15. There can also be a response or acknowledgement in the other direction and further reference will be made to this hereinafter. The central control 32 is connected to operating elements and may allow an operator to preset control instructions, such as power stages or the like.

Figure 2:
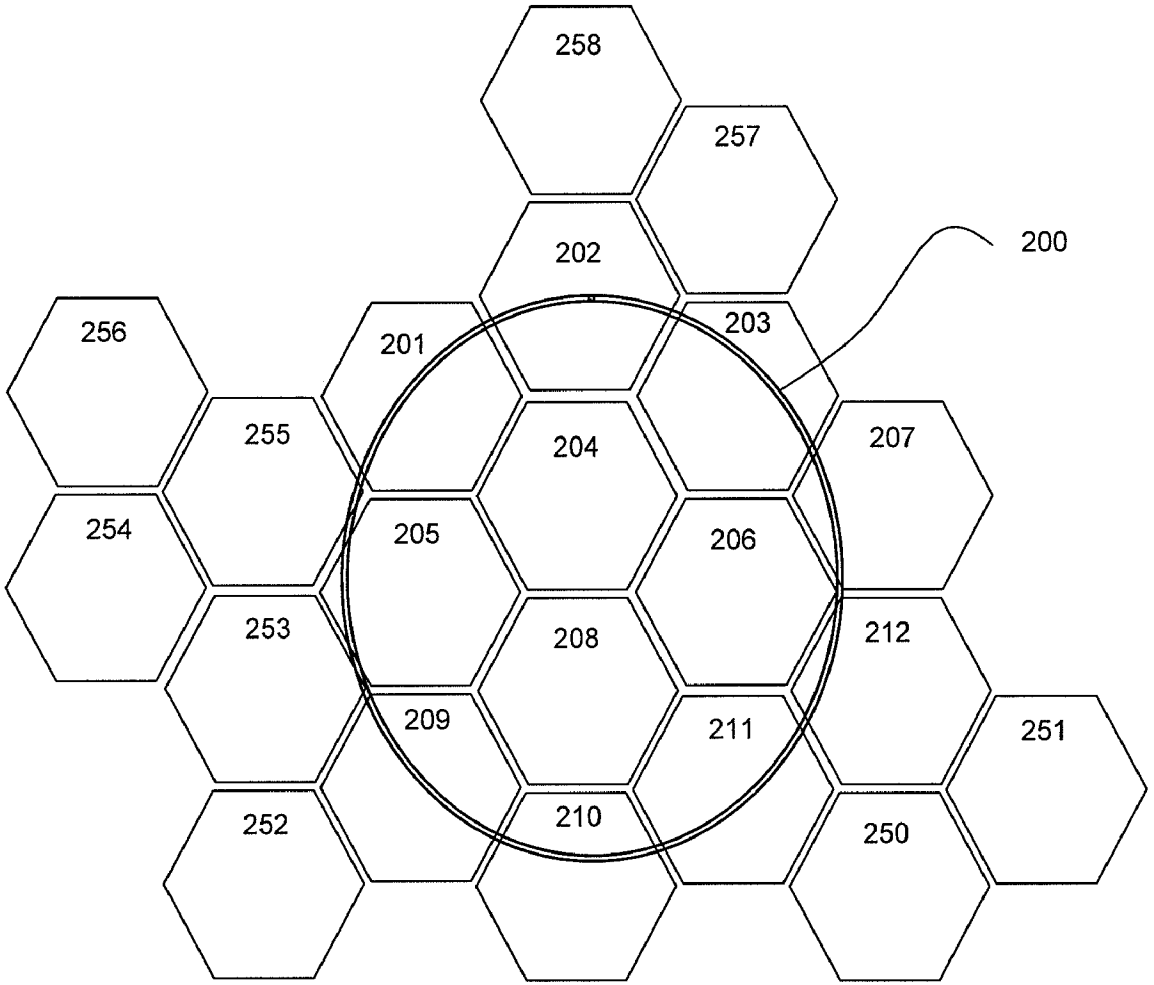
FIG. 2 is a depiction of one embodiment comprising a hexagon shaped layout of a plurality of heating elements.
Figure 3:
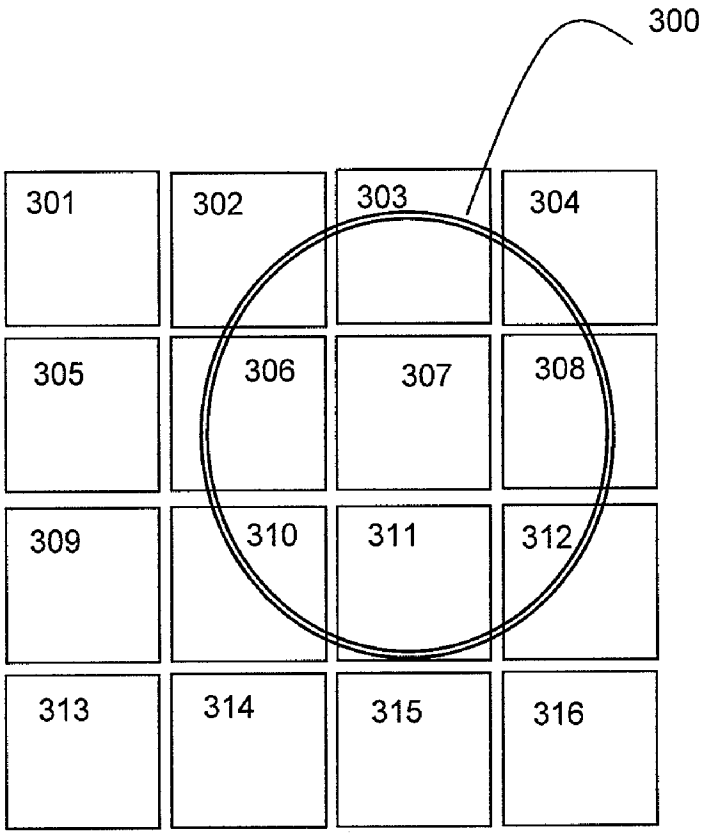
FIG. 3 is a depiction of another embodiment comprising a square shaped layout of a plurality of heating elements.

A cooking vessel 34, for example a metal saucepan, is positioned on the glass ceramic hob 11 and as illustrated in the embodiment of FIG. 1, covers at least three induction coils 15 or corresponding modules 13. In addition to the three modules shown, it is also possible to cover modules alongside the same and which are placed inside or outside the drawing plane. Such an arrangement of several modules serving as individual heating elements is known, for example, from the aforementioned DE 102 587 26.4, to which express incorporation by reference is made of the contents. In other embodiments, such as shown in FIG. 2 depicting a plane view, the saucepan 200 may be positioned over plurality of hexagonal shaped heating elements 201- 258. In this embodiment, some heating elements are completely 'covered' by the saucepan (namely heating elements 204, 208, 206), where others are only partially 'covered' by the saucepan (namely heating elements 209, 201, 202, 203 and others), and other heating elements are not covered at all (including heating elements, 258, 267, 251 and others. Similarly, for the embodiment shown in FIG. 3, the saucepan 300 is shown as covering heating element having a square shape 301-316.

The positive busbar 25 and negative busbar 26 are advantageously connected to rectified mains voltage, from which the converter 17 is supplied and operates the induction coils 15.

Function

The modules 13 have an independent saucepan detection function. This can be brought about in per se known manner in that at specific time intervals the induction coils 15 are temporarily activated. If a corresponding, suitable cooking vessel, such as cooking vessel 34, is located over an induction coil 15, this can be detected from the current flow and correspondingly evaluated as a saucepan detection. In the embodiment shown, this evaluation advantageously takes place through the determination of the current in converter 17 and processing in the converter control 18.

Thus, converter control 18 supplies an already evaluated and directly informative signal, for example "suitable saucepan in place", by means of the control terminals 28 to the bus system 30, which in turn passes the signal to central control 32. Central control 32 collects the signals for all the modules 13 and can consequently establish the occupancy situation of hob 11 or modules 13. For continuous surfaces of occupied modules 13, the central control 32 detects the place of a cooking vessel and supplies corresponding activation signals to said modules. These activation signals are dependent on the power setting desired by an operator, for example, in power stages from one to nine.

The corresponding control with the desired power stage is supplied by the central control 32, via bus system 30 and the control terminals 28, to the converter controls 18 of those modules 13 which are to be activated as a result of the saucepan detection. It is possible to accommodate in the central control 32 the fact that on detecting a ferromagnetic object by only one module 13, in the case of a corresponding small construction, that the object may not be a suitable cooking vessel, but may be instead, for examples a metal cutlery item or the like. This state is evaluated by the central control 32 as being incorrect and does not activate the affected module or induction coil 15. Instead, it is for example, possible to output to an operator a fault signal or other indication in order to indicate the detection of the object and eliminate the incorrect state.

The converter control 18 detects its control through the central control 32 in accordance with the structure of the bus system. It transforms the desired information concerning operation and activates the converter 17 in accordance with the power supply of induction coil 15. The induction coils 15 can be operated by means of converter 17 and converter control 18, in the same way as conventional induction coils for heating a hob. By means of the bus system 30, it is possible to operate a desired module individually and also detect the position of cookware on each module on the glass ceramic hob.

The major advantage of this inventive embodiment is that the modules 13 of induction coil 15, converter 17 and converter control 18 can be easily handled and assembled to form an overall heating device or hob. If one module is defective, it can be easily replaced by a functioning module.

As a result of a releasable connection 19 between induction coil 15 and converter 17, it is possible in the case of a replaced or defective module 13 to locate the fault and replace the faulty part. Therefore, it is not necessary on each occasion to replace a complete module.

As a result of the described possibilities of connecting the modules 13 to a power supply via busbars 25, 26 and to a control by means of control terminals 28 using bus system 30, fitting or connection can take place in an advantageous, simple manner. Unlike the prior art, there is no need in each case to have complicated cabling. In particular, replacement of defective modules can very easily take place without major connection work. The described possibility of retaining the connecting wires 20, 21 in spring clips 23 for fixing an overall module 13 with a simultaneous power supply, permits rapid installation and replacement.

The induction coil 15 can be operated in timed manner. It can also be operated with lowered or correspondingly reduced power levels compared with the full rated power. Mixed forms are also possible. In a further embodiment of the invention, it is possible in the case of a surface to be heated as a hotplate, to alternatively switch on the same through several induction heating elements, for example with an alternating regulation or power supply. Thus, a lower than full power level can be made available. By varying local heating of a cooking vessel, it is also possible to bring about a certain convection or movement in the cooking product, which contributes to rapid, uniform heating.

The induction coils can advantageously run in a type of casing, which can be round, particularly circular, at least for a coil area. Ferrites can be provided for bunching and shielding the magnetic field lines and the cross-section thereof can be as for known induction coils or have a horizontal E-shape.

It is also possible to provide so-called parboiling stages with temporarily increased power. The induction heating elements provide a temporary power which is significantly above the rated power thereof.

Apart from the described connection possibilities for the modules to separate busbars or a bus system, it is also possible to directly interconnect the modules using plug connections and this is advantageously in the lateral direction. Thus, the busbars or bus systems can be formed by the plurality of interconnected modules.

The invention claimed is:

1. A heating device in the form of a hob comprising:

a glass ceramic surface having a bottom side and a top side, wherein said top side is capable of supporting a cooking vessel;

a plurality of heating modules located juxtaposed relative to each other and positioned adjacent to said bottom side of said glass ceramic surface to form a heatable surface, wherein each heating module comprises an induction heating element, a converter operatively connected to said induction heating element, a converter controller controlling only said converter, said converter controller configured to communicate over a control bus, and a power connector for conveying electrical power to said converter;

a power bus, wherein each power connector of each one of the plurality of heating modules is connected to said power bus, said power bus providing power to each of said plurality of heating modules; and a microcontroller connected to said control bus, said microcontroller configured to communicate with each converter controller of said plurality of heating modules to control said respective heating module.

2. The heating device according to claim 1, for each heating module, said converter is detachably connected to said power bus using said power connector.

3. The heating device according to claim 1 the plurality of heating modules are located juxtaposed relative to each other so as to have a uniform gap between each other.

4. The heating device according to claim 1, wherein for each heating module, said induction heating element is capable of being detachably connected to said converter.

5. The heating device according to claim 4, wherein said converter is detachably connected to said power bus using an electrical connecting wire fixed in position using a spring clip.

6. The heating device according to claim 5, wherein said converter controller is detachably connected to said control bus.

7. The heating device according to claim 4 wherein said converter is fixed in position to said power bus by said power connector.

8. The heating device according to claim 4 wherein said converter controller is detachably connected to said control bus.

9. The heating device according to claim 1, wherein said power connector connects to a busbar providing power from a power supply.

10. The heating device according to claim 1, wherein said induction heating element has terminals to connect said induction heating element with said power supply.

11. The heating device according to claim 1, wherein said respective converter controller communicate via a said control bus with said microcontroller.

12. The heating device according to claim 1, wherein said control bus is a two-wire bus and is separate from said power bus.

13. The heating device according to claim 1, wherein each of said induction heating element has an external shape such that the juxtaposition of said plurality of heating modules form a heatable area on said hob.

14. The heating device according to claim 13, wherein said shape is a square.

15. The heating device according to claim 13, wherein said shape is a hexagon.

16. The heating device according to claim 1, wherein each said converter controller controlling said respective converter is configured to detect a presence of said cooking vessel on said top side of said glass ceramic surface.

17. The heating device according to claim 16, wherein said converter controller evaluates a current in said converter to detect said presence of said cooking vessel.

18. The heating device according to claim 16, wherein said converter controller is configured to detect said presence of said cooking vessel by evaluating a current flow during heating operation and said converter controller is configured to communicate a signal over said communication bus to said microcontroller indicating detection of said cooking vessel.

19. The heating device according to claim 1, wherein said induction heating element has associated monitoring means for monitoring of a power or a current flow through said induction coil.

20. The heating device according to claim 19, wherein said monitoring means are connected to said converter controller.

21. The heating device according to claim 1, wherein said microcontroller is capable to centrally control each individual heating module.

22. The heating device according to claim 21, wherein said microcontroller transmits to each converter controller detecting said cooking vessel a signal indicating a respective power level for each respective induction heating element.

23. The heating device according to claim 22, wherein said heating module has a maximum power of less than 1 kilowatt.

24. The heating device according to claim 1, wherein each said heating module is individually controllable by said microcontroller and a subset of the plurality of said heating modules are controlled as a group based on the detection of said cooking vessel.

25. The heating device according to claim 24 wherein said microcontroller detects a location at which said cooking vessel is placed on said hob based on signals received from said subset of the plurality of said heating modules.

* * * * *